US007685761B2

(12) United States Patent
Wu

(10) Patent No.: US 7,685,761 B2
(45) Date of Patent: Mar. 30, 2010

(54) TRIGGER ACTIVATING TACTICAL LIGHT GRIP

(76) Inventor: Chris Wu, 1F, No. 34 Alley 6, La. 104, Ansiang Rd., Sindian, Taipei County (TW) 231

( * ) Notice: Subject to any disclaimer, the term of this patent is extended or adjusted under 35 U.S.C. 154(b) by 0 days.

(21) Appl. No.: 12/185,833

(22) Filed: Aug. 5, 2008

(65) Prior Publication Data

US 2009/0084016 A1 Apr. 2, 2009

(30) Foreign Application Priority Data

Aug. 13, 2007 (TW) ..... 96213307 U

(51) Int. Cl.
*F41A 15/00* (2006.01)

(52) U.S. Cl. ..... 42/146; 42/114; 362/110; 362/113; 362/114

(58) Field of Classification Search ..... 42/146, 42/131, 114, 90; 362/110, 113, 114
See application file for complete search history.

(56) References Cited

U.S. PATENT DOCUMENTS 5,167,446 A * 12/1992 Haroutunian ..... 362/110
6,622,416 B2 * 9/2003 Kim ..... 42/146
6,641,277 B2 * 11/2003 Smith ..... 362/111
6,817,728 B2 * 11/2004 Goko ..... 362/111
6,892,488 B1 * 5/2005 Serravalle ..... 42/113
7,273,292 B2 * 9/2007 Kim ..... 362/112
7,305,790 B2 * 12/2007 Kay ..... 42/146
7,441,364 B2 * 10/2008 Rogers et al. ..... 42/146

* cited by examiner

*Primary Examiner*—J. Woodrow Eldred
(74) *Attorney, Agent, or Firm*—Ding Yu Tan

(57) ABSTRACT

A trigger activating tactical light grip includes a Picatinny rail mount to assemble the grip to the firearm, a tactical light mount to mount the tactical light and a grip to provide a place for holding the gun. In the grip, there is a trigger to initiate movement for a connecting rod, and the connecting rod is to deliver the movement of the trigger, a tunnel for the connecting rod to slide along, a circular shaft to assemble the trigger, and a fixing pin to keep the connecting rod to be contacted with the tactical light switch. When a user provides pressure with a finger on the trigger, it pivots on the circular shaft and leads the connecting rod to slide along the tunnel. As a result, the connecting rod exerts pressure to the switch of the tactical light and then the aim of activating the tactical light is accomplished.

9 Claims, 3 Drawing Sheets

TRIGGER ACTIVATING TACTICAL LIGHT GRIP

BACKGROUND OF THE INVENTION

1. Field of the Invention

The present invention relates to a trigger activating tactical light grip. More particularly, the invention relates to a grip and a connecting rod that is used to activate a tactical light of a shotgun or rifle.

2. Description of the Prior Art

The use of tactical lights is a trend in the operation of shotguns/rifles. It is attached directly to the shotgun/rifle by a mount with a tail-cap switch affixed to the end of the light. The tail-cap switch is fastened to the tactical grip with a loop fastener. One can turn on/off the light with a palm by pressing the pressure pad of a tail-cap switch. Designs of grip and various mounting combinations are available in the market, but the switching system still implements the traditional tail-cap switch design.

As the tail-cap switch employs an electro-mechanism design and the wire between the switch and tactical light is exposed outside of the gun, the wire is prone to damages and would cause the entire tail-cap switch and the tactical light to fail.

SUMMARY OF THE INVENTION

One purpose of the present invention of a trigger activating tactical light grip is to provide a linking mechanism that includes a trigger and a connecting rod to activate the tactical light. Basic functions of the present invention of a trigger activating tactical light grip are to connect the grip and the tactical light and to provide a place for a user for holding the gun.

The trigger activating tactical light grip includes a Picatinny rail mount to mount the grip to a Picatinny rail, a tactical light mount to mount the tactical light, and a grip to provide the place for holding the gun. The linking mechanism of the trigger and the connecting rod is fixed inside the grip to activate the light switching system. The trigger is operable and acts as a location whereby the user can press on it using his finger(s), and it is linked to the connecting rod by a hook. The connecting rod is a slidable device with an engagement opening at an end to connect with the trigger. When the trigger is pressed by the user using his fingers, the connecting rod slides along a tunnel, and the tactical light switch is activated at once. Further inside the grip, there is a circular shaft to locate the trigger and a fixing pin to keep the trigger linked and connected to the switch. When the grip is mounted to the Picatinny rail with the Picatinny rail mount, the tactical light is mounted with the tactical light mount, and the user using a finger of his hand while holding the grip is pressing the trigger, the trigger pivots around the circle shaft; and the connecting rod which links to the trigger will slide along the tunnel; and then the tactical light switch at the end of the tunnel is turned on, as a result of the sliding movement of the connecting rod.

Since the trigger activating tactical light grip combines the grip, the trigger and the connecting rod, it is possible to avoid drawbacks caused by the exposed wire as used in a tail-cap switch, and it is possible to ensure the performance stability of the tactical light.

DETAILED DESCRIPTION OF THE INVENTION

Figure 1:
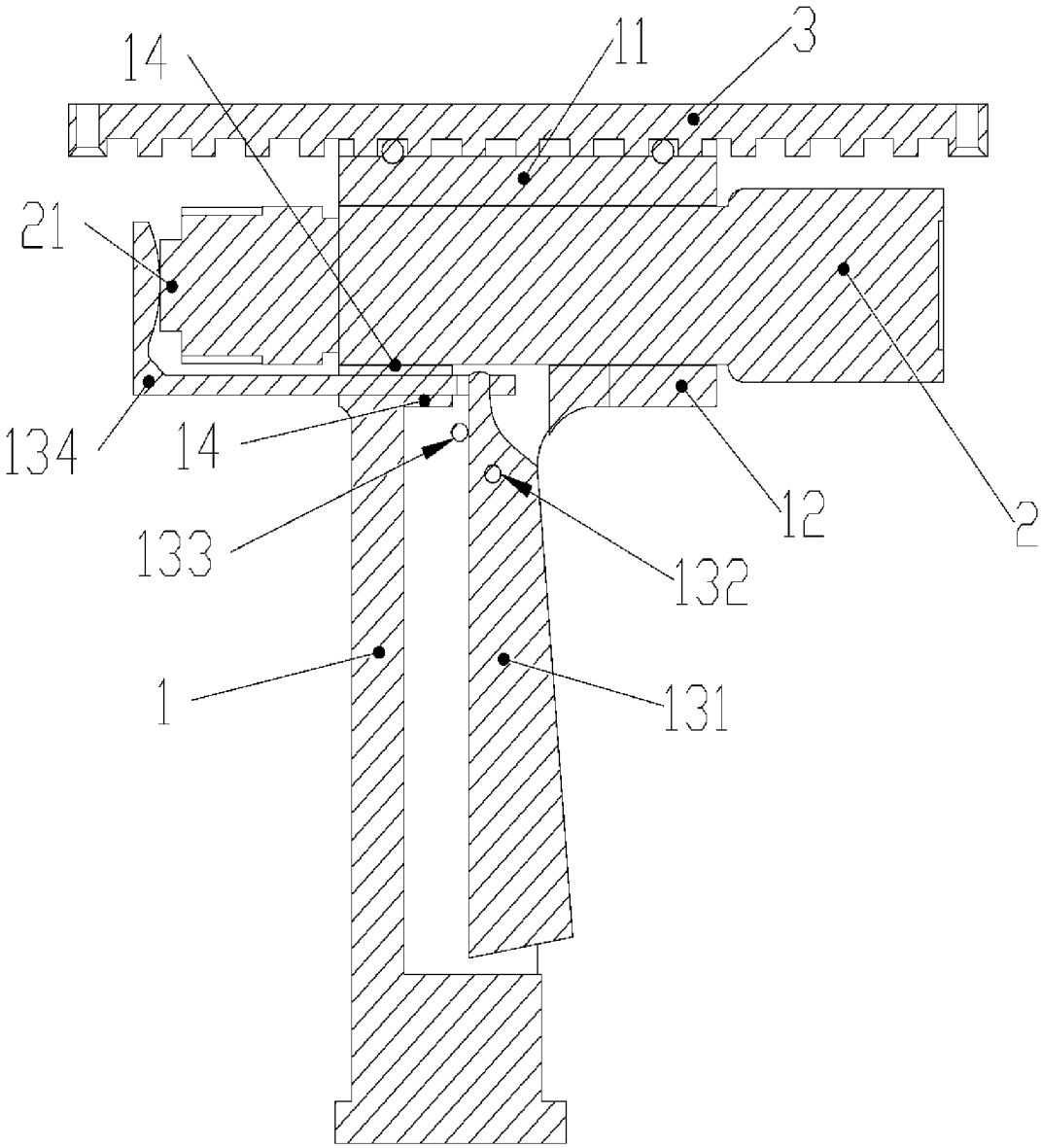
FIG. 1 is a cross sectional view of a trigger activating tactical light grip according to an embodiment of the present invention.
Figure 2:
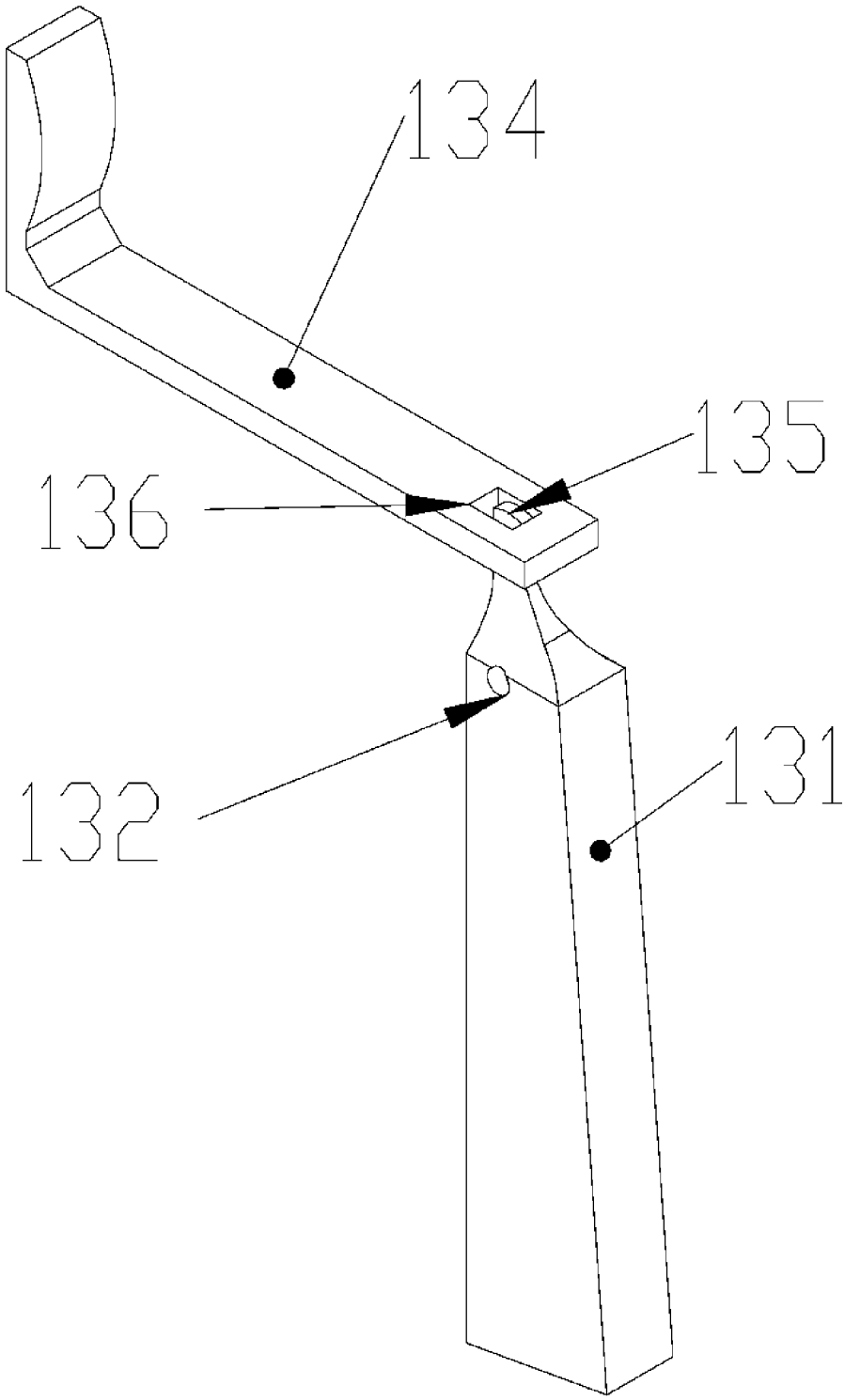
FIG. 2 is an assembly drawing of a trigger and a connecting rod of a trigger activating tactical light grip of the embodiment of the present invention.

FIG. 1 shows a cross sectional view of the trigger activating tactical light grip and FIG. 2 shows an assemble drawing of a trigger and a connecting rod. As illustrated in FIGS. 1 and 2, the trigger activating tactical light grip include a Picatinny rail mount (11), a tactical light mount (12) and a grip (1); more particularly, the grip (1) is comprised of a trigger (131), a connecting rod (134), a sliding tunnel (14), a circular shaft (132) and a fixing pin (133). Wherein the above, the Picatinny rail mount (11) is used to attach the grip (1) to the Picatinny rail (3), the tactical light mount (12) is to mount the tactical light (2) and, the grip (1) is to provide a place for the user to hold the gun. The trigger (131) and the connecting rod (134) are installed within the grip (1), and the trigger (131) is a movable device which links the connecting rod (134) to drive the sliding movement. The connecting rod (134) is a slidable part and is led by the trigger to slide along the tunnel (14) to provide pressure to the tactical light switch (21) to activate the tactical light switch (21). The tunnel (14) is fixed inside the grip (1) and provides the sliding space for the connecting rod (134). The circular shaft (132) is to couple the trigger (131) and the grip (1) and acts as a supporting point to the trigger (131). Finally, the fixing pin (133) is fixed at the rear of the trigger, so that the trigger (131) and the connecting rod (134) are contacted with the tactical light switch (21).

FIG. 2 shows an assembly drawing of the trigger (131) and the connecting rod (134) according to the embodiment of the present invention. A hook (135) is on the top of the trigger (131); and an engagement opening (136) is at the front end of the connecting rod (134). When assembling the trigger (131) and the connecting rod (134), the hook (135) and the engagement opening (136) are linked together and becomes a moveable joint. When the trigger (131) is pressed and pivoted, the connecting rod (134) is forced to slide forward.

Figure 3:
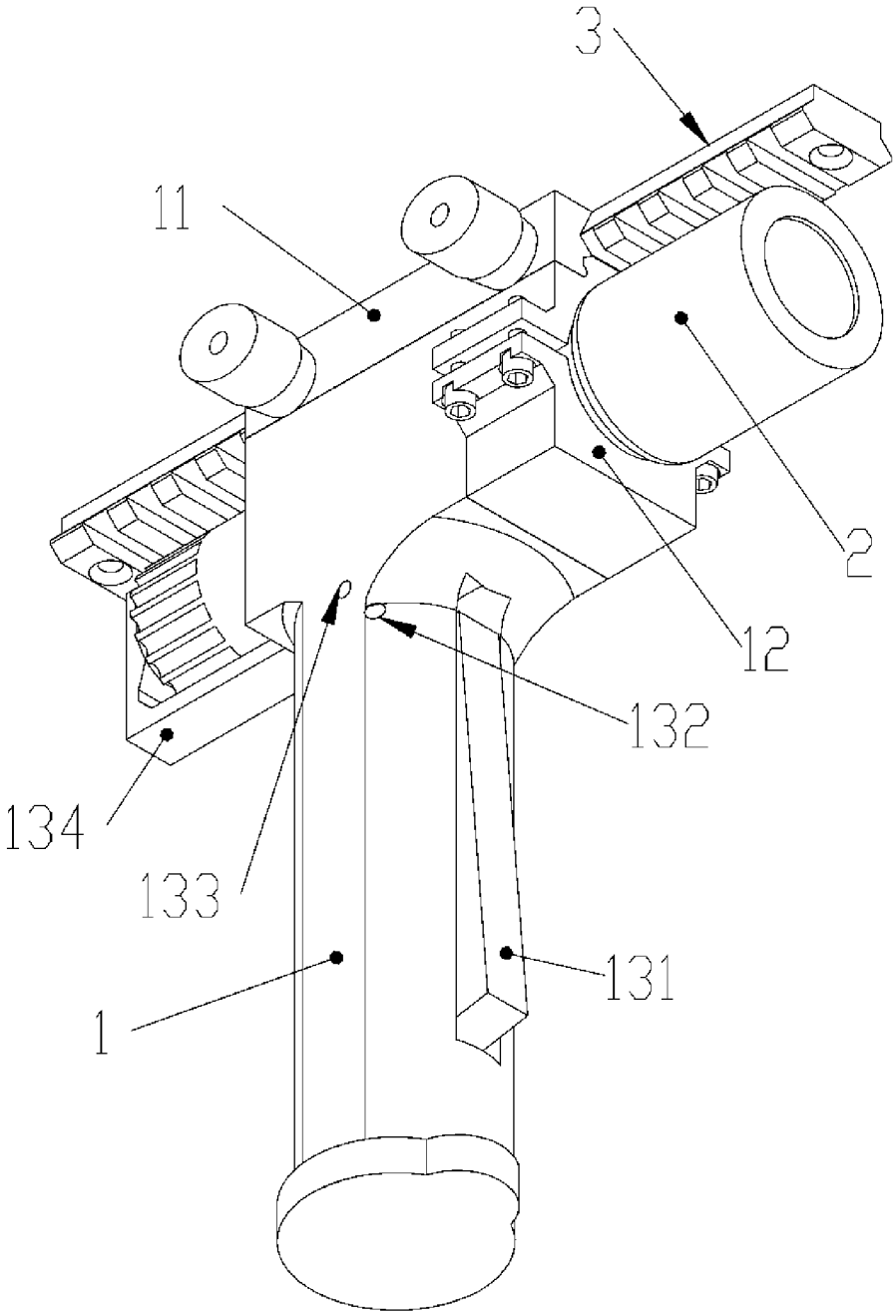
FIG. 3 is a 3 dimensional assembly drawing of a trigger activating tactical light grip according to the embodiment of the present invention.

FIG. 3 shows a 3 dimensional assembly drawing of the trigger activating tactical light grip according to the embodiment of the present invention, as illustrated, the trigger (131), the connecting rod (134) and the grip (1) are located, respectively. By pressing the trigger (131) using a finger of the hand which is holding the grip (1), the trigger (131) then pivots on the circular shaft (132) and initiates a sliding movement of the connecting rod (134). When the connecting rod (134) slides along the tunnel (14), the tactical light switch (21) is being pressed/depressed to turn on the tactical light (2). As a result, the purpose of turning on the tactical light (2) is fulfilled.

The trigger activating tactical light grip according to the embodiment of the present invention comprises the grip (1), the trigger (131), and the connecting rod (134), the tactical light (2) can be activated by using the trigger (131) and the connecting rod (134) mechanism, and is able to avoid the possible failure of a tail-cap switch. As a consequence, the performance stability of the tactical light (2) will be enhanced.

It is of course to be understood that the embodiment described herein is merely illustrative of the principles of the invention and that a wide variety of modifications thereto may be effected by persons skilled in the art without departing from the spirit and scope of the invention as set forth in the following claims.

The invention claimed is:

1. A trigger activating tactical light grip, comprising:

a Picatinny rail mount;

a tactical light mount; and a grip, wherein a Picatinny rail mount is mounted to the Picatinny rail, and the grip is attached to the Picatinny rail mount, and a tactical light is mounted to the tactical light mount; and the grip, comprising:

a trigger;

a connecting rod;

a sliding tunnel;

a circular shaft; and a fixing pin, wherein the trigger comprising a hook at the top to link up with an engagement opening at the front end of the connecting rod; and the trigger and the connecting rod are linked together inside the grip to activate the tactical light switch; and the trigger pivots on the circular shaft and initiates a sliding movement of the connecting rod along the sliding tunnel, and the tactical light is switched on or off by the user pressing on the trigger.

2. The trigger activating tactical light grip according to claim 1, wherein the trigger is assembled to the grip by means of the circular shaft.

3. The trigger activating tactical light grip according to claim 2, wherein the trigger pivots on the circular shaft as the circular shaft is a fulcrum acting as a lever to the trigger.

4. The trigger activating tactical light grip according to claim 1, wherein the linking method of the trigger and the connecting rod comprising of a mechanical joints connection.

5. The trigger activating tactical light grip according to claim 1, wherein the front end of the connecting rod is led by the trigger and the other end of the connecting rod exerts pressure to switch on/off the tactical light.

6. The trigger activating tactical light grip according to claim 1, wherein the grip and the Picatinny rail mount are coupled using a mechanical connection method.

7. The trigger activating tactical light grip according to claim 1, wherein the grip and the Picatinny rail mount are formed into one piece.

8. The trigger activating tactical light grip according to claim 1, wherein the grip and the tactical light mount are coupled using a mechanical connection method.

9. The trigger activating tactical light grip according to claim 1, wherein the grip and the tactical light mount are formed into one piece.

* * * * *